United States Patent [19]

Sumiyoshi et al.

[11] 4,207,849

[45] Jun. 17, 1980

[54] AIR-FUEL RATIO CONTROL APPARATUS OF A FUEL SUPPLY SYSTEM FOR AN INTERNAL COMBUSTION ENGINE

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Aisan Industry Co., Ltd., Ohbu, both of Japan

[21] Appl. No.: 932,939

[22] Filed: Aug. 11, 1978

[30] Foreign Application Priority Data

Aug. 30, 1977 [JP] Japan ..... 52-104074

[51] Int. Cl.[2] ..... F02M 39/00

[52] U.S. Cl. ..... 123/139 AW; 123/119 EC

[58] Field of Search ..... 123/119 EC, 139 AW

[56] References Cited

U.S. PATENT DOCUMENTS

| | | | |
|---|---|---|---|
| 3,680,535 | 8/1972 | Eckert et al. | 123/139 AW |
| 3,835,828 | 9/1974 | Knapp | 123/139 AW |
| 3,894,523 | 7/1975 | Stumpp | 123/139 AW |
| 3,993,034 | 11/1976 | Passara et al. | 123/139 AW |
| 3,999,527 | 12/1976 | Wessel et al. | 123/139 AW |
| 4,046,118 | 9/1977 | Aono | 123/119 EC |
| 4,079,713 | 3/1978 | Laprade et al. | 123/119 EC |
| 4,083,338 | 4/1978 | Berthing et al. | 123/119 EC |
| 4,090,486 | 5/1978 | Stumpp et al. | 123/139 AW |

*Primary Examiner*—Charles J. Myhre
*Assistant Examiner*—Raymond A. Nelli
*Attorney, Agent, or Firm*—Cushman, Darby & Cushman

[57] ABSTRACT

An air-fuel ratio control apparatus for an internal combustion engine has an air valve disposed in an intake passage downstream of a throttle valve to cooperate therewith to define an air pressure chamber and operative to maintain a substantially constant pressure therein. A fuel circuit includes a fuel discharge port open to the intake passage and a fuel-metering orifice operatively associated with the air valve such that the fuel-flowing section of the orifice is varied in proportion to the air-flowing section of the air valve. A constant differential fuel pressure valve is disposed in the fuel circuit to maintain a substantially constant fuel pressure difference across the fuel metering orifice during normal engine operation. The differential fuel pressure valve is mechanically operatively connected to a piston-cylinder assembly into which the fuel pressure upstream of the fuel-metering orifice is introduced. The position of the piston relative to the cylinder is varied when the engine operating condition is varied. The movement of the piston varies the fuel-flowing section of the differential fuel pressure valve thereby to vary the fuel pressure difference across the fuel-metering orifice whereby the air-fuel ratio is varied when the engine operating condition is varied.

5 Claims, 2 Drawing Figures

AIR-FUEL RATIO CONTROL APPARATUS OF A FUEL SUPPLY SYSTEM FOR AN INTERNAL COMBUSTION ENGINE

BACKGROUND OF THE INVENTION

1. Field of the Invention

The present invention relates to an air-fuel ratio control apparatus of a fuel supply system for an internal combustion engine and, more particularly, to an air-fuel ratio control apparatus for a fuel injection type internal combustion engine.

2. Description of the Prior Art

An air-fuel ratio control apparatus of a fuel supply system for an internal combustion engine has hitherto been known, which has an air valve disposed in an intake passage of the engine upstream of a throttle valve thereof to cooperate with the throttle valve to define an air pressure chamber and being operative to maintain a substantially constant pressure therein, a fuel circuit having at its downstream end a fuel discharge port open to the intake passage and fuel metering means comprising means defining a variable fuel-metering orifice disposed in the fuel circuit and operatively associated with the air valve such that the fuel-flowing section of the fuel-metering orifice is varied in proportion to the air-flowing section of the air valve, and a differential fuel pressure means operative to maintain a substantially constant fuel pressure difference across the fuel-metering orifice during normal engine operation. An example of the publications which disclose the air-fuel ratio control apparatus of the type referred to is Japanese Laid-Open Patent Publication (Pre-Examination Patent Publication) No. 48-83220 (83220/73).

In the air-fuel ratio control apparatus of the type specified above, the differential fuel pressure means is controlled in accordance with the operating conditions of the engine so that the fuel pressure difference across the fuel-metering orfice is varied according to the engine operating conditions to vary the air-fuel ratio of the mixture to be supplied into the engine. The differential fuel pressure means comprises a differential pressure valve disposed in the fuel circuit downstream of the fuel-metering orifice. An electromagnetic means is employed to control the fuel-flowing section of the differential pressure valve in dependence on the engine operating conditions. In the air-fuel ratio control apparatus disclosed in the Japanese publication referred to above, the differential pressure valve comprises a valve seat and a diaphragm cooperative therewith to define a fuel-flowing gap the size of which is controlled by the electromagnetic means operative in response to variation in the engine operating conditions. In the invention disclosed in the Japanese publication referred to, the engine operating conditions are detected simply by an $O_2$ sensor which detects the oxygen content of the engine exhaust gas. In the case where other means are employed to detect other engine operating parameters, such as an acceleration sensor and deceleration sensor, for example, in addition to the use of the $O_2$ sensor, an electric circuitry for controlling the electromagnetic means of the differential pressure valve will be complicated in structure and thus very epensive.

SUMMARY OF THE INVENTION

It is, therefore, an object of the present invention to provide an improved air-fuel ratio control apparatus of the type specified above, in which major parts of the means for controlling the fuel-flowing gap of the differential pressure valve in dependence on the engine operating conditions are formed of relatively inexpensive and reliably operable mechanical components and in which the required electric circuitry is structurally simplified and inexpensive.

In the improved air-fuel ratio control apparatus according to the present invention, the fuel pressure in the fuel circuit upstream of the fuel-metering orifice is kept at a substantially constant predetermined level higher than the atmospheric pressure and the differential fuel pressure means includes a valve seat disposed in the fuel circuit between the fuel-metering orifice and the fuel discharge port, a diaphragm disposed in opposite relationship to the valve seat to cooperate therewith to define a fuel-flowing gap therebetween, a spring biasing the diaphragm toward the valve seat and spring pressure controlling means responsive to variation in the engine operating conditions to vary the length of the spring thereby to control the force of the spring acting on the diaphragm whereby the fuel-flowing gap is varied to vary the fuel pressure in the fuel circuit downstream of the fuel-metering orifice for thereby varying the flow of the fuel through the fuel discharge port into the intake passage thereby to adjust the air-fuel ratio of an air-fuel mixture supplied into the engine.

In preferred embodiments of the invention, a second spring is disposed on the side of the diaphragm opposite the first spring to bias the diaphragm away from the valve seat. Either the fuel pressure in the fuel circuit upstream of the fuel-metering orifice or the atmospheric pressure is exerted to the surface of the diaphragm adjacent to the first spring.

The spring pressure controlling means may preferably comprise a cylinder communicated with the fuel circuit upstream of the fuel-metering orifice, a piston slidably mounted in the cylinder and having a surface exposed to the fuel pressure in the cylinder, means for varying the position of the piston relative to the cylinder in response to variation in the engine operating conditions, and means for operatively connecting the piston to the first spring such that the piston urges the first spring against the diaphragm.

The piston position varying means may preferably comprise a plurality of fuel outlet ports formed in the peripheral wall of the cylinder and mutually spaced in the axial direction of the cylinder, return passages hydraulically connecting the fuel outlet ports to a drain, respectively, solenoid valves of normally closed type disposed in the return passages, respectively, and means for controlling the solenoid valves, the valve controlling means being operative to selectively open the valves in dependence on the operating conditions of the engine. When a selected solenoid valve is opened, the piston is moved to a position to partially open the fuel outlet port associated with the opened solenoid valve. The movement of the piston is transmitted to the first spring so that the force of the spring acting on the diaphragm is varied with a result that the fuel-flowing gap between the diaphragm and the valve seat is varied to vary the fuel pressure in the fuel circuit downstream of the variable fuel-metering orifice whereby the flow of the fuel through the fuel discharge port into the intake passage is varied to adjust the air-fuel ratio of the mixture fed into the engine.

In the case where two solenoid valves are simultaneously opened, the piston is moved to a position where, of the two fuel outlet ports associated with the opened solenoid valves, the port which is nearer to a fuel inlet of the cylinder is partially opened by the piston. The piston is then held stationary at this position for a while. This feature is effective to enable the valve controlling means to be of a simplified structure. More specifically, in the case where the valve controlling means includes acceleration and deceleration sensors in addition to an $O_2$ sensor, it is advisable that, during an acceleration operation of the engine, an air-fuel ratio control based on the signal from the acceleration sensor takes a preference of the air-fuel ratio control based on the $O_2$ sensor output signal. Because substantial parts of the valve controlling means are in the form of an electric circuitry, if the electric circuitry were intended to achieve the air-fuel ratio control based on the acceleration sensor output signal in preference to the air-fuel ratio control based on the $O_2$ sensor output signal, the electric circuitry must be extensively complicated in structure. In the preferred embodiment of the present invention, however, the preferential operation does not rely on the operation of such an electric circuitry but is obtained from the positioning of the piston dependent on the fuel outlet ports formed in the peripheral wall of the cylinder. The electric circuitry of the valve controlling means is correspondingly simplified in structure.

The above and other objects, features and advantages of the present invention will be made apparent by the following description with reference to the accompanying drawings.

DESCRIPTION OF PREFERRED EMBODIMENTS

Figure 1:
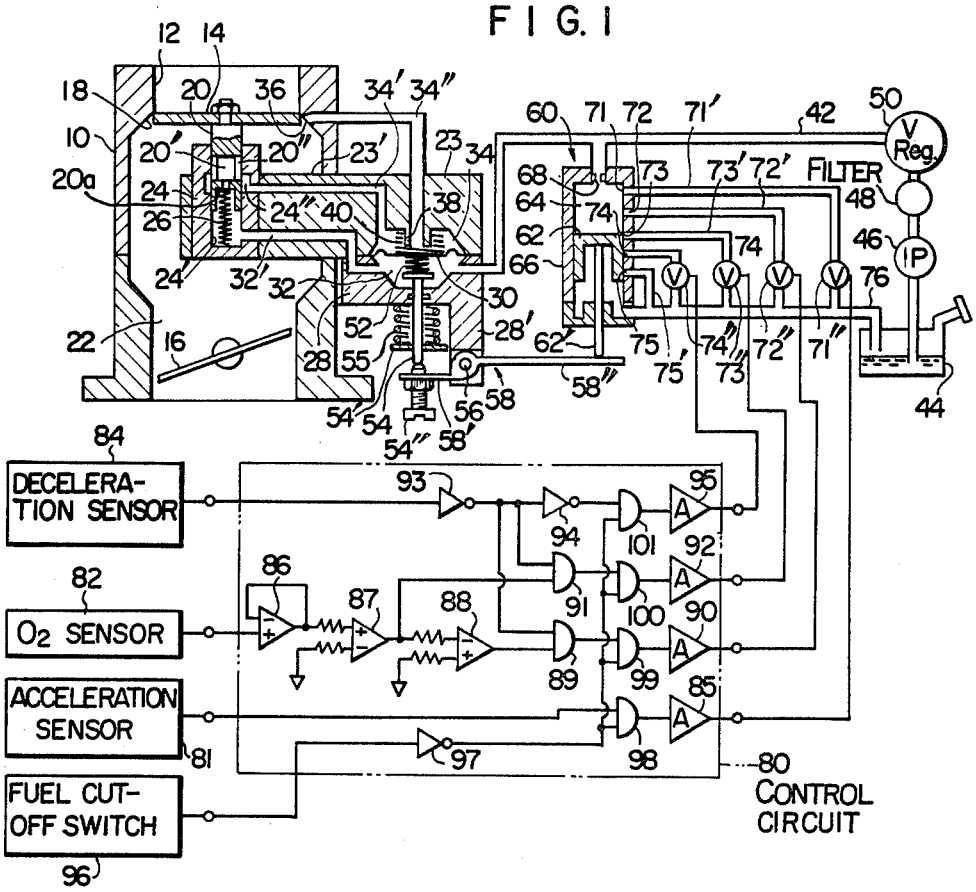
FIG. 1 shows schematically a fuel supply system for an internal combustion engine provided with an air-fuel ratio control apparatus according to an embodiment of the invention.

Referring to FIG. 1 which schematically shows an embodiment of the air-fuel ratio control apparatus for a fuel supply system of an internal combustion engine according to the invention, reference numeral 10 designates a cylindrical body which defines therein an air intake passage 12 and has an upper end to be connected to an air cleaner (not shown) and a lower end to be connected to an intake manifold (not shown) of an internal combustion engine (not shown). Disposed within the intake passage 12 are an air sensing plate 14 (to be termed "air valve" hereinafter) and a throttle valve 16 which are positioned in series to each other with the throttle valve 16 located downstream of the air valve 14. Air from the air cleaner flows through the passage 12 past the air valve 14 and the throttle valve 16 and is fed into engine cylinders (not shown) through the intake manifold thereof.

The throttle valve 16 itself is of a known structure and is adapted to be always biased toward the closed position by a spring (not shown) and rotated by an engine accelerator (not shown) thereby to control the intake air flow in a well known manner.

The air intake passage 12 has a frusto-conical inner wall 18 which diverges in the downstream direction. The air valve 14 is formed of a disk-like member and disposed transversely within the air intake passage 12 adjacent to the frusto-conical inner wall 18 and vertically movably supported by a rod 20 extending substantially coaxially with the air intake passage 12. The air valve 14 cooperates with the throttle valve 16 to define a constant depression chamber 22 therebetween in the air intake passage 12. Disposed on one side of the cylindrical body 10 is a block 23 having an arm-like portion 23' which projects into the air intake passage 12 in a fluid-tight manner through an aperture formed in the corresponding peripheral wall portion of the cylindrical body 10. A cylinder member 24 having a bottomed bore 24' formed therein is secured to the arm-like portion 23' at the inner end portion thereof. The rod 20 for supporting the disk-like air valve 14 is slidably accommodated in the bore 24' in a fluid-tight manner. A compression spring 26 is interposed between the lower end of the rod 20 and the bottom of the cylindrical bore 24' so that the rod 20 is biased upwardly by the spring 26.

With the arrangement described above, when throttle valve 16 is rotated toward its full open position by operation of the accelerator, the air pressure in the constant depression chamber 22 tends to be reduced. At this time, however, the air valve 14 will respond to such decrease in pressure and is moved downwardly against the spring 26 by the force exerted by the intake air flow, with a result that the area of the opening of the air valve 14, i.e., the area of annular passage defined between the periphery of the air valve 14 and the frusto-conical inner wall 18, is increased to admit a correspondingly increased air flow into the constant depression chamber 22. On the other hand, when the throttle valve 16 is rotated toward its closed position, the pressure in the constant depression chamber 22 will begin to rise, so that the velocity of the intake air flowing past the air valve 14 is decreased to permit the air valve 14 to be moved upwardly by the force of the spring 26 thereby to decrease the area of the annular passage defined between the air valve 14 and the frusto-conical inner wall 18. In this manner, the pressure within the air pressure chamber 22 can be maintained substantially constant independently from variations in the flow of the intake air feed to the engine.

Referring again to FIG. 1, a member 28 is mounted on the underside of the block 23 with a diaphragm 30 being interposed therebetween. The underside of the block 23 and the upper side of the member 28 are respectively formed with recesses which are oppposed to each other and each of which cooperates with the diaphragm 30 to define a first chamber 32 and a second chamber 34, respectively. The first chamber 32 is communicated with the cylinder bore 24' in the vicinity of the bottom thereof through a passage 32' which is formed in and extends through the member 28, the block 23 and the cylinder member 24, while the second chamber 34 is communicated with the cylinder bore 24' at a top portion thereof through a passage 34' formed in the block 23 and the cylinder member 24. Further, the second chamber 34 is communicated to a fuel discharge port 36 in the air suction passage 12 or the constant depression chamber 22 through a passage 34'' extending through the peripheral wall of the cylindrical body 10. The passage 34'' is opened into the second chamber 34 through a sleeve-like valve seat 38 which projects downwardly or toward the diaphragm 30 from the block 23. A coil spring 40 is disposed around the valve seat 38 and bears on the diaphragm 34 to resiliently urge the latter away from the valve seat 38.

The first chamber 32 is connected to a fuel tank 44 by a fuel feed line 42 in which a fuel pump 46, a fuel filter 48 and a pressure regulator 50 are provided. The fuel is fed by the pump 46 to the cylinder bore 24' near the bottom thereof through the conduit or pipe line 42, the first chamber 32 and the passage 32' under a substantially constant predetermined pressure which is maintained higher than the atmospheric pressure by the action of the pressure regulator 50.

The rod 20 for supporting the disk-like air valve 14 serves also to measure or meter the flow of the fuel from the bore 24 into the passage 34', the second chamber 34 and the passage 34" (In this sense, the rod 20 will be termed "fuel metering rod".). More particularly, the fuel metering rod 20 is formed with a fuel passage 20' which extends axially from the bottom of the rod 20 for a predetermined distance. Formed at an intermediate portion of the passage 20' is an annular spring seat 20a which receives the spring 26 at the upper end thereof, while the lower end thereof bears against the bottom of the cylinder bore 24'. Further, slits 20" are formed in the peripheral wall of the passage 20' and axially extend between the upper end thereof and the spring seat 20a. On the other hand, an annular groove 24" is formed in the inner wall of the cylinder member 24 so as to provide communication between the passages 20' and 34' through the slits 20". The arrangement is such that the area of overlap between the slits 20" and the annular groove 24" and hence degree of communication between the passages 20' and 34' will vary in proportion to variation in the area of opening defined between the air valve 14 and the frusto-conical inner wall 18 of the constant depression chamber 22 because the air valve 14 is fixedly supported by the vertically slidable rod 20. In other words, the slits 20' cooperates with the annular groove 24" to form a variable fuel-metering orifice in the fuel circuit between the fuel source and the fuel discharge port 36, the area of opening or the fuel-flowing section of the variable fuel-metering orifice being variable in proportion to the opening of the air valve 14 (i.e. sectional area of the annular passage defined between the periphery of the air valve 14 and the frusto-conical inner wall 18 of the air pressure chamber 22).

With the arrangement described above, the air pressure within the air pressure chamber 22 will remain substantially constant as described hereinbefore. Further, the pressure present in the air intake passage 12 upstream of the air valve 14 is substantially equal to the atmospheric pressure and thus can be considered to be at a substantially constant level. Accordingly, the pressure difference across the air valve 14 is substantially constant. Thus, the flow of the intake air into the engine will be proportional to the area of opening of the air valve 14. On the other hand, the fuel-flowing sectional area or the opening of the variable fuel-metering orifice formed by the slits 20" and the annular groove 24" in the fuel circuit varies in proportion to the area of opening of the air valve 14, as described hereinbefore. Thus, so far as the difference in fuel pressure across the variable fuel-metering orifice (20', 24") remains constant, the flow of fuel discharged into the air intake passage 12 through the fuel discharge port 36 will be proportional to the flow of the intake air through the air valve 14 into the internal combustion engine. For these reasons, the air-fuel ratio of the air-fuel mixture fed into the engine will be always substantially constant, provided that no variation occurs in the pressure difference across the variable fuel-metering orifice (20" and 24").

Next, the relations described above will be discussed with the aid of mathematical equations: Assuming that the area of opening of the air valve 14 is represented by $A_a$, while the air pressures in the air intake passage 12 upstream and downstream of the air valve 14 are represented by $P_o$ and $P_a$, respectively, the intake air quantity $G_a$ can be given by the following equation;

$$G_a \propto A_a\sqrt{P_o - P_a} \ldots \quad (1)$$

On the other hand, the fuel-flowing sectional area of the variable fuel-metering orifice (20", 24") in the fuel circuit is represented by $A_f$ while the fuel pressures upstream and downstream of the orifice are represented by $P_h$ and $P_c$, respectively, the fuel flow $G_f$ into the engine is given by;

$$G_f \propto A_f\sqrt{P_h - P_c} \ldots \quad (2)$$

From the equations (1) and (2), the air-fuel ratio $G_a/G_f$ is given by the following equation;

$$G_a/G_f \propto \frac{A_a}{A_f} \cdot \frac{\sqrt{P_o - P_a}}{\sqrt{P_h - P_c}} \quad (3)$$

Since the pressure differential $P_o - P_a$ and $P_h - P_c$ are constant, respectively, the air fuel-ratio $G_a/G_f$ will be maintained constant.

In the air fuel ratio control apparatus of the type described above, the present invention is intended to adjust the air-fuel ratio by varying the pressure difference $P_h - P_c$ across the variable fuel-metering orifice (20", 24") in accordance with the operating conditions of the internal combustion engine. For this purpose, a spring 52 is provided in the first chamber 32 to bias the diaphragm 30 towards the valve seat 38 in the second chamber 34. Further, the force of the spring 52 acting on the diaphragm 30 is varied in accordance with the operating conditions of the engine by a spring force controlling means which is of a simplified construction, hardly susceptible to malfunctions and failures and can be easily repaired.

In the illustrated embodiment of the invention, the spring force controlling means includes a rod 54 extending vertically and slidably through the member 28 to support the lower end of the spring 52 in the first chamber 32. The rod 54 has a spring retainer 54' secured to the rod at the exterior portion thereof projecting outwardly from the first chamber 32. A coil spring 55 is disposed around the rod 54 between the underside of the member 28 and the retainer 54' to bias the rod 54 downwardly. The member 28 has a downward dependent portion 28' on which a two-armed lever 58 is pivotally mounted by a pin 56. One arm 5' of the lever 58 supports the lower end of the rod 54 through an adjusting screw 54", while the other arm 58" of the lever 58 supports a piston rod 62' of a piston 62 of a piston means 60 which will be described hereinafter in detail. The rod 54 is operative to transmit to the lever 58 a combined force of the three springs 40, 52 and 55 tending to rotate the lever 58 counterclockwise, while the rod 62' of the piston 62 exerts a force of the lever 58 tending to rotate the latter in the clockwise direction. The clockwise and counterclockwise forces acting on the lever 58 are substantially balanced during normal operation of the engine. In this balanced state, the rod 54 will remain stationary and thus the spring force exerted upwardly onto the diaphragm 30 by the spring 52 will be substantially constant. Accordingly, nevertheless of a gap being present between the diaphragm 30 and the valve seat 38 which allows the fuel to flow therethrough, the difference in pressure between the first and second chamber 32 and 34 on the opposite sides of the diaphragm 30 will be maintained at a substantially constant level. In this manner, the flow of the fuel from the second chamber 34 to the passage 34'' is kept substantially constant so far as the operating condition of the engine is maintained constant. More particularly, since the fuel pressure within the cylinder 24' is maintained at a constant level by the actions of the pump 46 and the regulator 50 as described hereinbefore, the fuel pressure diference $P_h - P_c$ across the variable fuel-metering orifice (20'', 24'') is also maintained constant, which results in a constant air-fuel ratio ($G_a/G_f$).

The piston 62 is adapted to be displaced downwardly or upwardly from its normal position corresponding to the normal operating condition of the engine for the reasons which will be discussed hereinunder. Assuming that the piston 62 is caused to move upwardly from the normal position, the rod 54 is moved downwardly to increase the distance between the diaphragm 30 and the upper end of the rod 54, so that the force of the spring 52 exerted onto the diaphragm 30 will be reduced. Consequently, the force of spring 40 will then become more predominant than the force of the spring 52 which acts on the diaphragm 30 in opposition to the former, with a result that the gap between the valve seat 38 and the diaphragm 30 is increased to reduce the resistance to the fuel flow from the second chamber 34 to the passage 34''. Thus, the fuel pressure difference $P_h - P_c$ across the variable fuel-metering orifice (20'' and 24'') is increased to decrease the air-fuel ratio ($G_a/G_f$), i.e. enrich the air-fuel mixture supplied into the engine. By way of example, when the difference term $P_h - P_c$ of the equation (3) referred to above is increased by 10%, the air-fuel mixture will be enriched about 5% in air-fuel ratio.

It will thus be appreciated that the valve seat 38, the diaphragm 30, the springs 40, 52, 55, the rod 54 and the lever 58 disposed in the fuel feed system as well as the piston means 60, which will be described below in more detail, cooperate together to form a differential pressure means which is operative to vary the fuel pressure difference $P_h - P_c$ across the variable fuel-metering orifice (20'', 24'') thereby to adjust the air-fuel ratio of the mixture to be fed into the internal combustion engine.

The piston means 60 referred to above includes a cylinder body 66 formed therein with a cylinder bore 64 in which the piston 62 is slidably accommodated. The cylinder bore 64 is communicated with the fuel feed pipe 42 through a fixed restriction 68. In the peripheral wall of the cylinder body 66, there are formed first to fifth fuel outlet ports 71, 72, 73, 74 and 75 which are spaced from each other in the axial direction of the cylinder body 66 and connected to a drain pipe 76 through first to fifth fuel return passages 71', 72', 73', 74' and 75', respectively. It is to be noted that the fifth outlet port 75 is so located that at least a part thereof will open into the cylinder bore 64 when the piston 62 is displaced to the lowermost position. The first to fourth fuel return passages 71' to 74' are provided with normally closed types of solenoid valves 74'', 72'', 73'' and 74'', respectively. However, no solenoid valve is disposed in the fifth fuel return passage 75'. Further, it should be noted that the overall flow resistance of each of the first to fifth fuel return passage 71' to 75', inclusive of the flow resistances provided by the associated outlet ports 71 to 75 and the solenoid valves, is so selected as to be significantly smaller than the flow resistance provided by the fixed restriction 68. The first to fourth solenoid valves 71'' to 74'' are adapted to be opened or closed in dependence on the operating conditions of the engine by means of a control circuit 80 which will be described hereinafter.

The piston means 60 is arranged such that, when the piston 62 is positioned to partially close any outlet port (e.g. port 75) associated with a fuel return passage (e.g. 75'), the clockwise torque exterted to the lever 58 by the fuel pressure exerted onto the top surface of the piston 62 is balanced with the counterclockwise torque exterted to the lever 58 by the combined force of the springs 40, 52 and 55. In the state shown in FIG. 1 in which the piston 62 partially closes the outlet port 73 associated with the third fuel return passage 73', the forces exerted onto the lever 58 through the rod 54 and the piston rod 62', respectively, are balanced with each other. In this state, the other fuel return passages 71', 72', 74' and 75' are not in the positions to allow the cylinder bore 64 to be communicated with the drain pipe 76 for the reasons to be described later. With the state shown in FIG. 1, if the solenoid valve 71'' is opened, the fuel within the cylinder bore 64 will be discharged into the drain pipe 76 through the first return passage 71' to decrease the pressure in the cylinder bore 64. Consequently, the piston 62 is caused to move upwardly by the combined force of the springs 40, 52 and 55 until a new position is attained in which the first outlet port 71 is partially closed. At this new position, the combined spring force is again balanced with the fuel pressure exerted onto the piston 62 in the direction opposite to that of the combined spring force. On the other hand, if the solenoid valve 73'' is closed in the state shown in FIG. 1 (i.e. all the solenoid valves are closed), the fuel pressure within the cylinder bore 64 will be increased to move the piston 62 downwardly until a further new position is attained in which the fifth exit port 75 is partially closed. At the further new position, the fuel pressure acting on the piston 62 is again balanced with the combined force of the springs 40, 52 and 55.

In this manner, the upward movement of the piston 62 increases the length of the spring 52 acting on the diaphragm 30 to relax the spring 52 with a result that the gap between the diaphragm 30 and the valve seat 38 is increased. Thus, the fluid pressure difference across the variable fuel-metering orifice (22'', 24'') is increased to correspondingly reduce the air-fuel ratio or enrich the air-fuel mixture. On the contrary, the downward movement of the piston 62 increases the air-fuel ratio (i.e. the air-fuel mixture becomes leaner) for the reason in reverse of what has been described above.

It will thus be appreciated that the air-fuel ratio is corrected or adjusted in dependence on the positions of the piston 62 which in turn are controllably determined by the on-off operations of the solenoid valves 71'' to 74'' adapted to be controlled by the control circuit 80 in dependence on parameters representing the operating conditions of the engine. In the illustrated embodiment of the invention, output signals of an acceleration sensor 81, an oxygen ($O_2$) sensor 82 for detecting the air-fuel ratio and a deceleration sensor 84, all of which are provided to detect the operating conditions of the engine, are supplied into the control circuit 80 as the input signals thereto.

More specifically, the control circuit 80 includes a first amplifier 85 which is adapted to receive the output signal of the acceleration sensor 81 through an AND gate 98. The amplifier output signal of the amplifier 85 is directly fed to the first solenoid valve 71'' thereby to open the same. The output signal of the $O_2$-sensor 82 is input to an operational amplifier 86, the output of which in turn is applied to an input of a first comparator 87. The output signal of the first comparator 87 is applied to an input of a second comparator 88 whose output is fed to an input of an AND gate 89. The output signal of the AND gate 89 is then fed to a second amplifier 90 through another AND gate 99, which amplifier 90 has an output directly coupled to the second solenoid valve 72'' for energizing it to the open state. The output signal of the first comparator 87 is additionally applied to an input of an AND gate 91 the output signal of which is fed to a third amplifier 92 through an AND gate 100. The output signal from the third amplifier 92 is fed to the third solenoid valve 73'' to open the same. The output signal of the deceleration sensor 84 is fed to a fourth amplifier 95 through a first inverter 93, a second inverter 94 and an AND gate 101. The output signal from the fourth amplifier 95 is applied to the fourth solenoid valve 74'' to open the same. The output signal from the first inverter 93 is also applied to the other inputs of the AND gates 89 and 91. Reference numeral 96 denotes a fuel cut-off switch which is connected to the control circuit 80 for breaking the power supply to all of the first to fourth solenoid valves 71'' to 74'' when no fuel supply to the engine is required. The switch 96 is adapted to produce an output signal when fuel supply to the engine is to be interrupted. The output signal of the switch 96 is inverted through a third inverter 97 and applied to the other inputs of the AND gates 98, 99, 100 and 101 for disenabling them. Thus, the output signals of these AND gates will be all logic "0" to deenergize the solenoid valves 71'', 72'', 73'' and 74'' for closing them when fuel supply to the engine is to be cut off.

As is well known to those skilled in the art, the $O_2$ sensor 82 is adapted to detect the oxygen content of exhaust gas from the internal combustion engine and exhibits such performance characteristics that the output voltage of the $O_2$-sensor 82 will abruptly rise up when the air-fuel ratio of the air-fuel mixture supplied to the engine becomes smaller (mixture becomes richer) than the stoichiometric air-fuel ratio at which a three-way catalyst can exhibit the maximum exhaust gas purification capability, while the output voltage of the $O_2$-sensor is abruptly lowered when the air-fuel ratio of the mixture becomes larger (mixture becomes leaner) than the stoichiometric air-fuel ratio. The output voltage signal of the $O_2$-sensor 82 is applied through the operational amplifier 86 to one input terminal of the first comparator 87 and compared with a reference voltage applied to the other input terminal of the comparator 87. The reference voltage is preset to accord with the stoichiometric air-fuel ratio of the air-fuel mixture. When the input voltage of the comparator 87, i.e. the output voltage of the operational amplifier 86, is lower than the reference voltage, the output signal of the comparator 87 will be logic "0" and inverted by the second comparator 88 to become logic "1". On the other hand, when the output signal voltage from the operational amplifier 86 as applied to the one input terminal of the first comparator 87 is higher than the reference voltage at the other input thereof, the output signal of the comparator 87 will be logic "1" and hence the output of the second comparator 88 will be logic "0".

Next, description will be made with respect to operation of the described air-fuel ratio control apparatus. As described hereinbefore, the air-fuel ratio of the mixture fed into the internal combustion engine becomes small (the mixture becomes richer) upon upward movement of the piston 62, while the air-fuel ratio becomes large (the mixture becomes leaner) upon downward movement of the piston 62. Assuming that the engine is in a normal operating condition, the output signals of the acceleration sensor 81 and the fuel cut-off switch 96 will be both logic "0"s, so that the solenoid valve 71'' will remain in the closed state. Further, because the output signal of the deceleration sensor 84 is also logic "0", the output signal of the inverter 93 will be logic "1" and hence the output of the inverter 94 will be logic "0", whereby the fourth solenoid valve 74'' will also remain in the closed state. In this operating condition of engine, therefore, the adjustment of the air-fuel ratio will be made in dependence on the output signal of the $O_2$-sensor 82. More particularly, when the actual air-fuel ratio of the mixture being fed into the engine is smaller than the stoichiometric air-fuel ratio, the output signal voltage of the operational amplifier 86 will be higher than the reference voltage of the comparator 87, resulting in logic "1" output of the comparator 87 and hence in logic "0" output of the second comparator 88. In this case, since, the output logic "1" of the inverter 93 is applied to the AND gates 89 and 91 at the respective one inputs thereof, the output of the AND gate 89 will be logic "0", which results in that the second solenoid valve 72'' remains closed. On the other hand, the output of the AND gate 91 is logic "1" since the latter has the other input applied with logic "1" output from the comparator 87, whereby the third solenoid valve 73'' is opened. Thus, the piston 62 will be moved downwardly to the position where the third outlet port 73 is partially closed (i.e., the position shown in FIG. 1). The operation of the engine will continue in this state for a while with the piston 62 located at the attained position. In the meantime, when the air-fuel ratio becomes higher (mixture becomes leaner) than the stoichiometric air-fuel ratio, the output signal voltage of the $O_2$-sensor 82 will be lowered, as a result of which the output signal of the operational amplifier 86 will become lower than the reference voltage applied to the comparator 87, the output signal of which will then become logic "0". Thus, the output signal of the AND gate 89 will be logic "1", while the output signal of the AND gate 91 will be logic "0". The second solenoid valve 72'' is thus opened, while the third solenoid valve 73'' resumes its closed position. Consequently, the piston 62 is moved upwardly to the position where the second outlet port 72 is partially closed. The air-fuel ratio is thus adjusted or corrected in the decreasing sense.

In the case of the accelerating operation of the engine, the air-fuel ratio is required to be sufficiently small (rich) for attaining the desired acceleration. In this case, no output signal is produced by the deceleration sensor 84, but the acceleration sensor 81 will produce an output signal, resulting in the opening of the first solenoid valve 71''. The piston 62 will then be moved upwardly to the position in which the first outlet port 71 is partially closed, whereby the air-fuel ratio is reduced (i.e. the air-fuel mixture is enriched).

During the accelerating operation, since the $O_2$-sensor 82 detects that the actual air fuel ratio is smaller than the stoichiometrical air-fuel ratio, the output signal of the comparator 87 will become logic "1". Further, since the deceleration sensor 83 produces no output signal, the output signal of the inverter 93 will take a logic "1" level. Thus, the third solenoid valve 73" will also be opened due to logic "1" output from the AND gate 91. The fact that the first and third solenoid valves 71" and 73" are both opened, however, that the return flow of fuel from the cylinder bore 64 to the drain pipe 76 is greater than the flow of fuel into the cylinder bore 64 through the fixed restriction 68. Thus, the piston 62 is moved upwardly to the position in which the fuel flow into the cylinder bore 64 is balanced with the fuel flow therefrom, that is, the position where the first outlet port 71 is partially closed by the piston 62. It will thus be appreciated from the above description that the operation of the air-fuel ratio control apparatus in the accelerating mode of the engine operation will undergo utterly no influence of the output signal from the $O_2$-sensor 82 by virtue of the unique construction of the piston means 60. This enables the control circuit 80 to be of a quite simplified structure without any complicated means for making ineffective the circuitry associated with the $O_2$-sensor during the accelerating operation of the engine.

In the case of the decelerating operation of the engine, the acceleration sensor 81 will produce no output signal so that the first solenoid valve is in the closed state. However, due to a logic "1" output of the deceleration sensor 84, the inverter 93 will output logic "0", which results in the logic "1" output of the inverter 94 and hence the opening of the fourth solenoid valve 74". Further, since the output logic "0" of the inverter 93 is applied to the AND gates 89 and 91 at the respective one inputs thereof, the outputs of these gates will become logic "0" irrespectively of the output signal state of the $O_2$-sensor 82. Under the circumstances, both of the second and third solenoid valves 72" and 73" are closed thereby to cause the piston 62 to move downwardly to the position in which the fourth outlet port 74 is partially closed. Thus, the air-fuel ratio is increased (mixture becomes leaner).

When no fuel supply to the engine is required, the fuel cut-off switch 96 is turned off. Then, the logic "0" output of the inverter 97 will be applied to the one inputs of the AND gates 98, 99, 100 and 101, resulting logic "0" outputs thereof. Consequently, no electric power will be supplied to the first to fourth solenoid valves 71", 72", 73" and 74" which thus are all closed. Under the circumstances, the piston 62 will be moved downwardly to the position in which the fifth outlet port 75 is partially closed. Then, the rod 54 supporting the spring 52 will be moved to its uppermost position in which the diaphragm 30 is caused to be in sealing engagement with the valve seat 38, whereby the fuel flow from the chamber 34 to the fuel discharge port 36 will be interrupted.

Figure 2:
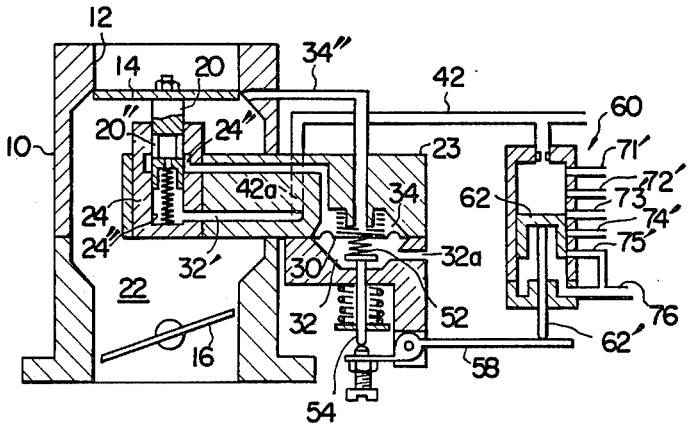
FIG. 2 shows another embodiment of the air-fuel ratio control apparatus according to the invention.

FIG. 2 shows a second embodiment of the invention. The parts of the second embodiment similar to those of the first embodiment are designated by similar reference numerals. The second embodiment is differred from the first embodiment in that the fuel feeding conduit 42 is connected to a passage 42*a* formed in the block 23 and is connected to the passage 32'. The first chamber 32 is not supplied with fuel pressure but communicated with the atmosphere through an air vent opening 32*a*. Since the atmospheric pressure may be regarded to be always constant, the air pressure acting on the underside of the diaphragm 30 is constant as is in the case of the first embodiment. However, because the fuel pressure in the fuel supply conduit 42 is set at a level higher than the atmospheric pressure, as discussed previously, the force of spring 52 disposed within the first chamber 32 in the second embodiment is selected so as to be slightly different from that of the corresponding spring in the first embodiment. Except for these differences, the second embodiment shown in FIG. 2 is identical to the first embodiment described above in conjunction with FIG. 1.

What is claimed is:

1. An air-fuel ratio control apparatus for an internal combustion engine having an intake passage and a throttle valve disposed therein, said apparatus comprising an air valve disposed in said intake passage upstream of said throttle valve to cooperate therewith to define an air pressure chamber and being operative to maintain a substantially constant pressure therein; a fuel circuit having at its downstream end a fuel discharge port open to said intake passage; and fuel metering means comprising means defining a variable fuel-metering orifice disposed in said fuel circuit and operatively associated with said air valve such that the fuel-flowing section of said fuel-metering orifice is varied substantially in proportion to the air-flowing section of said air valve; and a differential fuel pressure means operative to maintain a substantially constant fuel pressure difference across said fuel-metering orifice during normal engine operation, the fuel pressure in said fuel circuit upstream of said fuel-metering orifice being kept a substantially constant predetermined level higher than the atmospheric pressure, said differential fuel pressure means including a valve seat disposed in said fuel circuit between said fuel-metering orifice and said fuel discharge port, a diaphragm disposed in opposite relationship to said valve seat to cooperate therewith to define a fuel-flowing gap therebetween, spring means acting on said diaphragm, and spring pressure controlling means responsive to variation in the engine operating conditions to vary the force of said spring means thereby to control the force of said spring acting on said diaphragm whereby said fuel-flowing gap is varied to vary the fuel pressure in said fuel circuit downstream of said fuel-metering orifice for thereby varying the flow of the fuel through said fuel discharge port into said intake passage thereby to adjust the air-fuel ratio of an air-fuel mixture supplied into the engine, wherein said spring pressure controlling means comprises a cylinder communicated with said fuel circuit upstream of said fuel-metering orifice, a piston slidably mounted in said cylinder and having a surface exposed to the fuel pressure in said cylinder, means for varying the position of said piston relative to said cylinder in response to variation in the engine operating conditions, and mechanical means operatively connecting said piston to said spring means such that the movement of said piston in said cylinder varies the force of said spring means on said diaphragm.

2. An air-fuel ratio control apparatus according to claim 1, wherein said piston position varying means includes a plurality of fuel outlet ports formed in the peripheral wall of said cylinder and mutually spaced in the axial direction of said cylinder, return passages hydraulically connecting said fuel outlet ports to a drain, respectively, solenoid valves of normally closed type disposed in said return passages, respectively, and means for controlling said solenoid valves, said valve controlling means being operative to selectively open said valves in dependence on the operating conditions of the engine, whereby the air-fuel ratio is controlled through digital process.

3. An air-fuel ratio control apparatus according to claim 2, wherein said valve controlling means includes an $O_2$ sensor for detecting the oxygen content of the engine exhaust gas and producing an electric output signal and an electric circuitry associated with said $O_2$ sensor whereby the output of said $O_2$ sensor is fed back for the control of the air-fuel ratio at least on the basis of the $O_2$ sensor output.

4. An air-fuel ratio control apparatus according to claim 2 or 3, wherein said spring means includes a first spring member biasing said diaphragm toward said valve seat and a second spring member biasing said diaphragm away from said valve seat, said differential fuel pressure means further including a chamber accommodating said first spring member and hydraulically connected to said fuel circuit upstream of said fuel-metering orifice, said mechanical connecting means extending between said first spring member and said piston.

5. An air-fuel ratio control apparatus according to claim 2 or 3, wherein said spring means includes a first spring member biasing said diaphragm toward said valve seat and a second spring member biasing said diaphragm away from said valve seat, the surface of said diaphragm adjacent to said first spring member being exposed to the atmospheric pressure, said mechanical connecting means extending between said first spring member and said piston.

* * * * *